US006703782B2

(12) United States Patent
Otani et al.

(10) Patent No.: US 6,703,782 B2
(45) Date of Patent: Mar. 9, 2004

(54) PLASMA DISPLAY PANEL

(75) Inventors: Eishiro Otani, Yamanashi-ken (JP); Chiharu Koshio, Yamanashi-ken (JP); Hitoshi Taniguchi, Yamanashi-ken (JP)

(73) Assignees: Pioneer Corporation, Tokyo (JP); Pioneer Display Products Corporation, Shizuoka-ken (JP)

( * ) Notice: Subject to any disclaimer, the term of this patent is extended or adjusted under 35 U.S.C. 154(b) by 0 days.

(21) Appl. No.: 10/307,437

(22) Filed: Dec. 2, 2002

(65) Prior Publication Data

US 2003/0127981 A1 Jul. 10, 2003

(30) Foreign Application Priority Data

Jan. 8, 2002 (JP) ..... 2002-001313

(51) Int. Cl.[7] ..... H01J 17/49
(52) U.S. Cl. ..... 313/585; 313/584
(58) Field of Search ..... 313/582, 584, 313/585; 345/41, 55, 60; 315/169.4

(56) References Cited

U.S. PATENT DOCUMENTS 5,742,122 A * 4/1998 Amemiya et al. ..... 313/582
6,195,070 B1 * 2/2001 Shinoda et al. ..... 345/60
6,465,956 B1 * 10/2002 Koshio et al. ..... 313/586

* cited by examiner

*Primary Examiner*—Ashok Patel
(74) *Attorney, Agent, or Firm*—Arent Fox Kintner Plotkin & Kahn

(57) ABSTRACT

In a surface-discharge-type alternating-current plasma display panel, a discharge cell is divided into two cells: a display discharge cell C1 providing for a sustaining discharge between transparent electrodes Xa, Ya of row electrodes X, Y; and an addressing discharge cell C2 which is opposite a bus electrode Yb of the row electrode Y, giving rise to an addressing discharge in association with a column electrode D, to provide for the addressing discharge between the bus electrode Yb of the row electrode Y and a column electrode D. The display discharge cells C1 and the addressing discharge cells C2 of the discharge cells are interposed in alternate positions in the column direction so as to arrange the addressing discharge cells C2 in a back-to-back position in the column direction.

13 Claims, 7 Drawing Sheets

V—V SECTION

PLASMA DISPLAY PANEL

BACKGROUND OF THE INVENTION

1. Field of the Invention

The invention relates to a panel structure of a surface-discharge-type alternating-current plasma display panel.

The present application claims priority from Japanese Applications No. 2002-1313, the disclosures of which are incorporated herein by reference for all purposes.

2. Description of the Related Art

In recent years, surface-discharge-type alternating-current plasma display panels (hereinafter referred to as "PDP") have been receiving attention as slim, large sized color screen displays, and are becoming increasingly common in homes and the like.

Such PDPs typically include a front glass substrate and a back glass substrate opposite to the front glass substrate with a discharge space in between.

The front glass substrate is provided on its back surface with a plurality of row electrode pairs regularly arranged in the column direction and each extending in the row direction to form a display line, and a dielectric layer covering the row electrode pairs.

The back glass substrate is provided on the surface facing the front glass substrate with a plurality of column electrodes regularly arranged in the row direction and each extending in the column direction to intersect the row electrode pairs.

Thus, discharge cells are respectively formed at areas in the discharge space corresponding to the intersections of the column electrodes and the row electrodes. Red, green and blue phosphor layers are provided inside the individual discharge cells in the order of red, green and blue colors.

In the operation of the PDP for displaying an image, in an addressing period following a reset period for carrying out a reset discharge, an addressing discharge is selectively caused between one row electrode in the row electrode pair and the column electrode opposite the one row electrode in the individual discharge cell, for distribution of lighted cells (the discharge cell having wall charges formed on the dielectric layer) and non-lighted cells (the discharge cell having no wall charges formed on the dielectric layer) over the panel surface in accordance with an image to be displayed.

In a sustaining emission period following the addressing period, a discharge sustaining pulse is applied alternately to the paired row electrodes of the row electrode pairs in all of the display lines in order to excite the wall charges on the dielectric layer in each lighted cell to cause a sustaining discharge between the paired row electrodes. Then, ultraviolet light generated by the sustaining discharge excites the red, green or blue phosphor layer in each discharge cell to allow it to emit light for the generation of a display image.

In the prior art PDPs having a construction as described above, the addressing discharge occurs across the same discharge cell with the interposition of the red, green or blue phosphor layer as the sustaining discharge occurring in it. For this reason, the addressing discharge is subjected to influences ascribable to the phosphor layer, such as discharge properties varying among the phosphor materials of the three colors forming the phosphor layers, variations in the thickness of the phosphor layers produced in the manufacturing process for the PDP, and the like. Hence, the prior art PDPs have a significant difficulty in ensuring uniform addressing discharge properties among the individual discharge cells.

The prior art PDPs as described above needs a large discharge space in each discharge cell for an increase in the luminous efficiency. If a partition wall defining the discharge cells is increased in height for increasing the luminous efficiency, then this means an increase in the interval between the row electrode and the column electrode between which the addressing discharge is produced. This increased interval produces a problem of an increase in the starting voltage for the addressing discharge.

To solve the problems associated with the prior art as described above, the applicant of the present application suggested a PDP having the following structure in Japanese Patent Application No. 2001-213846 filed prior to the present application.

As illustrated in FIG. 9 and FIG. 10, the suggested PDP includes a partition wall 15 formed on the surface of a back glass substrate 13 facing the display screen and including first transverse walls 15A, second transverse walls 15B and vertical walls 15C. The first transverse walls 15A and the vertical walls 15C of the partition wall 15 partition the discharge space defined between a front glass substrate 10 and the back glass substrate 13 into discharge cells.

Each of the discharge cells is divided into two cells by the second transverse wall 15B: a display discharge cell C1*a* opposite transparent electrodes Xa and Ya of a row electrode pair (X, Y), and an addressing discharge cell C2*a* opposite back-to-back bus electrodes Xb and Yb of the adjacent row electrode pairs (X, Y). The display discharge cell C1*a* and the addressing discharge cell C2*a* are adjacent to each other in the column direction on either side of the second transverse wall 15B, and communicate with each other by means of a clearance r' formed between the front face of the interposed second transverse wall 15B and a protective layer covering an additional dielectric layer 12.

A protrusion rib 17 protrudes from a portion of the back glass substrate 13 facing each addressing discharge cell C2*a* into the addressing discharge cell C2*a*, to raise the corresponding part of the column electrode D in the direction of the inside of the addressing discharge cell C2*a*. Hence, a space-distance s2 between the part of the column electrode D and the bus electrode Yb facing the addressing discharge cell C2*a* is smaller than a space-distance s1 between a part of the column electrode D and the transparent electrode Ya facing the display discharge cell C1*a*.

In the suggested PDP, when a scan pulse is applied to the row electrodes Y and a data pulse is applied to the column electrodes D in the addressing period following the reset period, the addressing discharge occurs within the addressing discharge cell C2*a* because the space-distance s2 between the bus electrode Yb of the row electrode Y and the column electrode D opposite to each other on either side of the addressing discharge cell C2*a* is smaller than the space-distance s1 between the transparent electrode Ya of the row electrode Y and the column electrode D opposite to each other on either side of the display discharge cell C1*a*.

Charged particles generated through the addressing discharge in the addressing discharge cell C2*a* pass through the clearance r' to flow into the display discharge cell C1*a* which is adjacent to the addressing cell C2*a* concerned, with the second transverse wall 15B in between. Thus, lighted cells and non-lighted cells are distributed in all of the display lines L on the panel in accordance with an image to be displayed.

FIG. 11 shows another construction of the suggested PDP described thus far. The PDP shown in FIGS. 9 and 10 includes the protrusion rib 17 provided for raising the column electrode D inside the addressing discharge cell C2*a*, whereas the PDP shown in FIG. 11 includes a column electrode D' having a conventional linear shape, and a dielectric layer 18 formed of high ϵ (epsilon) materials is formed in an addressing discharge cell C2'*a* to reduce the virtual discharge-distance between the column electrode D' and the bus electrode Yb between which the addressing discharge is created.

However, both PDPs constructed as described above have a problem of a reduction in margins at the addressing discharge if variations in the space-distances s2 between the bus electrode Yb and the column electrode D' raised in the addressing discharge cell C2*a* by the protrusion rib 17 (see FIG. 10) or in the discharge space between the bus electrode Yb and the surface of the high ϵ (epsilon) materials-made dielectric layer 18 formed in the addressing discharge cell C2'*a* (see FIG. 11), are produced when the PDP is manufactured.

The above PDP has an arrangement of row electrodes Y provided with a scan pulse for the addressing discharge between itself and the column electrode D and row electrodes X not-involved in the addressing discharge in alternate positions in the column direction. Therefore, there is another problem of an increase in reactive power resulting from the discharge capacity formed in the non-display area between the back-to-back row electrodes X and Y of the adjacent row electrode pairs (X, Y) in the column direction when a sustaining pulse is alternately applied to the row electrodes X and Y of the row electrode pair (X, Y) to cause the sustaining discharge.

SUMMARY OF THE INVENTION

The present invention has been made to solve the problems associated with the prior art surface-discharge-type alternating-current plasma display panel as described above.

Accordingly, it is an object of the present invention to provide a surface-discharge-type alternating-current plasma display panel achieving the stabilization of the addressing discharge properties in each discharge cell, and also a reduction in discharge starting voltage for an addressing discharge and in reactive power produced at the sustaining discharge.

To attain the above object, the present invention provides a plasma display panel including: a front substrate; a plurality of row electrode pairs regularly arranged in a column direction on a back surface of the front substrate, and each extending in a row direction to form a display line and constituted by first and second row electrodes; a back substrate placed opposite the front substrate with a discharge space intervening between; and a plurality of column electrodes regularly arranged in the row direction on a surface of the back substrate facing toward the front substrate, and each extending in the column direction to intersect the row electrode pairs and form unit light-emitting areas in the discharge space at the respective intersections. The plasma display panel according to a first feature of the present invention comprises: a first discharge area provided in each of the unit light-emitting area and facing opposed parts of the first and second row electrodes to provide for a discharge between the first and second row electrodes; and a second discharge area provided in each of the unit light-emitting area and facing a part of the first row electrode, positioned opposite to a part thereof opposing the second row electrode and creating a discharge in association with the column electrode, to provide for a discharge between the part of the first row electrode and the column electrode, the first discharge areas and the second discharge areas in the individual unit light-emitting areas being arranged in alternate positions in the column direction so that the second discharge areas of the respective unit light-emitting areas adjacent to each other are arranged in a back-to-back position in the column direction.

The plasma display panel in the first feature includes unit light-emitting areas each divided into two areas: the first discharge area experiencing a sustaining discharge created between the opposed parts of the first and second row electrodes constituting the row electrode pair to produce visible light for the generation of an image, and the second discharge area experiencing an addressing discharge created between the column electrode and the first row electrodes in the row electrode pair to establish lighted cells (the first discharge areas having wall charges formed therein) and non-lighted cells (the first discharge areas having no wall charges formed therein) over the panel surface. Charged particles produced by the addressing discharge in the second discharge area divided from the first discharge area transfer from the second discharge area into the first discharge area forming the same unit light-emitting area together with the second discharge area concerned. Thus, the lighted cells and the non-lighted cells are distributed over the panel surface of the plasma display panel in accordance with an image to be displayed.

After that, a sustaining pulse is applied alternately to the first row electrode and the second row electrode constituting each row electrode pair, whereupon a sustaining discharge occurs in the lighted cells, and the phosphor layers of the three primary colors, red, green and blue, formed in the individual first discharge areas are excited to emit light. The image is thus generated on the panel surface in response to an image signal.

In the plasma display panel, the positions of the first discharge areas and the second discharge areas in the individual unit light-emitting areas in a column direction are transposed alternately between adjacent display lines so that the second discharge areas of the adjacent unit light-emitting areas are arranged back to back with each other in the column direction. This arrangement allows alternate transposition of the first row electrode and the second row electrode in each of the row electrode pairs in adjacent display lines in the column direction. Hence, the row electrodes of the row electrode pairs are arranged with the same-type electrodes in back-to-back position in the column direction.

According to the first feature, in this way the addressing discharge between the column electrode and the first row electrode is created in the second discharge area which is separated from the first discharge area provided for the sustaining discharge between the first and second row electrodes of the row electrode pair. Hence, it is unnecessary for a phosphor layer for generating visible light to be formed in the second discharge area. The present invention successfully frees the addressing discharge in the second discharge area from the conventionally disadvantageous influences produced by the phosphor materials different among the colors forming the phosphor layers and the variations in the thickness of the phosphor layers, thus providing stabilized discharge properties of the addressing discharge.

The arrangement of the second discharge areas for the addressing discharge in a back-to-back position in the column direction makes it possible to arrange the same-type electrodes of the row electrodes, constituting the individual row electrode pairs, in a back-to-back position in the column direction. Due to this arrangement, when a sustaining pulse is applied to the row electrode pairs to cause a sustaining discharge, discharge capacity is not formed in the non-display area located between the back-to-back row electrodes in the column direction, resulting in preventing the production of extra reactive power.

Further, even when the plasma display panel is designed to have a large discharge space in each first discharge area for an increase in the luminous efficiency, it is possible to reduce the discharge starting voltage for the addressing discharge because a discharge-distance between the column electrode and the row electrode which are opposite to each other across the second discharge area is adjustable at will.

To attain the aforementioned object, a plasma display panel according to a second feature comprises, in addition to the configuration of the first feature, a protrusion protruding from the back substrate in the direction of the front substrate and extending in the row direction, to establish a partition between the second discharge areas positioned back to back with each other in the column direction.

With the second feature, the protrusion protrudes from the back substrate between the back-to-back second discharge areas in between adjacent unit light-emitting areas in the column direction. The back-to-back second discharge areas are blocked from each other in the row direction by the protrusion. For this reason, the addressing discharges respectively created in the second discharge areas are prevented from having an effect on each other.

To attain the aforementioned object, a plasma display panel according to a third feature has, in addition to the configuration of the second feature, a configuration in which both side faces of the protrusion respectively facing the second discharge areas are inclined toward each other so as to narrow toward an leading end of the protrusion, and parts of the column electrode facing the second discharge areas follow the inclined side faces of the protrusion to protrude toward the front substrate, and the part of the column electrode inclined along each of the inclined side faces of the protrusion is opposite to the part of the first row electrode, positioned opposite to the part thereof opposing the second row electrode, to cause the discharge between the part of the column electrode and the corresponding part of the first row electrode.

The plasma display panel of the third feature is so constructed that the part of the column electrode opposite the first row electrode across the second discharge area for the addressing discharge is inclined along the inclined side face of the protrusion facing the second discharge area and projects toward the front substrate. Hence, a discharge distance between the first row electrode and the column electrode with the second discharge area intervening decreases or increases continuously in the column direction.

With the third feature, even if there are variations in the distance between the front substrate and the back substrate or in the height of the protrusion, a proper discharge distance is ensured between the row electrode and any point of the inclined part of the column electrode, to provide a stabilized addressing discharge.

To attain the aforementioned object, a plasma display panel according to a fourth feature, in addition to the configuration of the second feature, has a configuration in which a leading end of the protrusion is in contact with part of the front substrate to block the second discharge areas positioned back to back in the column direction from each other. The plasma display panel comprises: a dividing wall extending in the row direction and providing a division between the paired first and second discharge areas forming the unit light-emitting area, and a communication element provided between the dividing wall and the front substrate for communication between the paired first and second discharge areas.

With the fourth feature, the leading end of the protrusion formed between the back-to-back second discharge areas in the column direction is in contact with part of the front substrate to completely block the back-to-back second discharge areas from each other. However, between the first discharge area and the second discharge area which are paired with each other to form a single unit light-emitting area, there is provided a communication element between the front substrate and the dividing wall dividing off the paired first and second discharge areas from each other, to allow charged particles produced by the addressing discharge in the second discharge area to properly transfer into the first discharge area paired with the second discharge area concerned.

To attain the aforementioned object, a plasma display panel according to a fifth feature comprises, in addition to the configuration of the second feature, a shielding wall provided on a portion of the protrusion between the second discharge areas adjacent to each other in the row direction and projecting from both side faces of the protrusion to shield the adjacent second discharge areas in the row direction from each other.

With the fifth feature, the protrusion is provided with a shielding wall which projects from both the side faces of the protrusion respectively in the column directions to shield adjacent second discharge areas in the row direction from each other. This shield prevents the addressing discharge occurring in one second discharge area from spreading into another second discharge area adjacent thereto in the row direction, resulting in the proper introduction of charged particles produced by the addressing discharge into the first discharge area paired with the second discharge area concerned.

To attain the aforementioned object, a plasma display panel according to a sixth feature has, in addition to the configuration of the first feature, a configuration in which a part of the column electrode facing each second discharge area is increased in width.

With the sixth feature, the column electrode is designed to have an increased width in the part opposite to the row electrode on both sides of the second discharge area for the creation of the addressing discharge between the column and row electrodes, for an increase of an electrode area in order to stabilize the discharge properties of the addressing discharge. Further, selectively establishing the width of the column electrode facilitates the control of the amount of charged particles to be produced by the addressing discharge.

To attain the aforementioned object, a plasma display panel according to a seventh feature has, in addition to the configuration of the first feature, a configuration in which the first row electrode and the second row electrode which constitute each row electrode pair are alternately transposed in the column direction so that the first row electrodes of the adjacent row electrode pairs are arranged back to back and the second row electrodes are similarly arranged back to back.

With the seventh feature, the row electrodes constituting the row electrode pairs are arranged such that the same-type row electrodes are back to back in the column direction. Due to this arrangement, when a sustaining pulse is applied to the row electrode pair and the sustaining discharge occurs, discharge capacity is not formed in the non-display area located between the row electrodes in a back-to-back position in the column direction, which then prevents then occurrence of extra reactive power resulting from the sustaining discharge.

To attain the aforementioned object, a plasma display panel according to an eighth feature comprises, in addition to the configuration of the first feature, a black- or dark-colored light absorption layer provided on a portion of the front substrate opposite each of the second discharge areas.

With the eighth feature, when viewed from the front substrate, the non-display area on the panel corresponding to the second discharge areas is covered with the black- or dark-colored light absorption layer formed on the front substrate. This light absorption layer prevents the reflection of ambient light incident through the front substrate for an improvement in contrast in a displayed image, and also prevents the light emission generated by the addressing discharge in the second discharge area from leaking toward the display surface of the panel.

To attain the aforementioned object, a plasma display panel according to a ninth feature has, in addition to the configuration of the eighth feature, a configuration in which the light absorption layer is formed on the part of the first electrode opposite the column electrode with the second discharge area intervening between.

With the ninth feature, a black- or dark-colored light absorption layer is formed on the portion of the first row electrode opposite to the column electrode for the creation of the addressing discharge in the second discharge area, in order to prevent the reflection of ambient light incident on the non-display area of the panel for an improvement in contrast in a displayed image, and also to prevent the light generated by the addressing discharge in the second discharge area from leaking toward the display surface of the panel.

To attain the aforementioned object, a plasma display panel according to a tenth feature comprises, in addition to the configuration of the first feature, a phosphor layer provided only in the first discharge area for generating a visible light by means of a discharge.

With the tenth feature, a phosphor layer for generating a visible light by means of a discharge is formed only in the first discharge area, but not formed in the second discharge area. This construction allows the stabilization of the discharge properties of the addressing discharge because the addressing discharge occurring in the second discharge area is never subjected to the conventional disadvantageous influences produced by the phosphor materials different among the colors forming the phosphor layers and the variations in the thickness of the phosphor layers.

To attain the aforementioned object, a plasma display panel according to an eleventh feature comprises, in addition to the configuration of the first feature, a protrusion projecting from the back substrate toward the front substrate and extending in the row direction between the first discharge areas arranged in the column direction for creating a partition between the first discharge areas arranged in the column direction, in which the second discharge area is formed between a leading end face of the protrusion and the back surface of the front substrate, and the column electrode is projected toward the front substrate by the protrusion to allow a part of the column electrode projected toward the front substrate to be opposite to the part of the first row electrode, positioned opposite to the part thereof opposing the second row electrode, with the second discharge area intervening between.

In the plasma display panel of the eleventh feature, the protrusion functions as a partition wall for providing a boundary between the first discharge areas arranged in the column direction. In addition, the column electrode projected toward the front substrate by the protrusion is opposite the first row electrode with the second discharge area intervening which is formed between the leading end face of the protrusion and the back surface of the front substrate.

With the eleventh feature, the protrusion which forms the second discharge area between itself and the front substrate and causes the column electrode to project toward the front substrate and be opposed to the row electrode, functions as a partition wall for providing a boundary between the adjacent first discharge areas to eliminate the need for additionally providing a partition wall.

To attain the aforementioned object, a plasma display panel according to a twelfth feature comprises, in addition to the configuration of the eleventh feature, an additional element protruding from the front substrate backward to come in contact with a central position in the column direction of the leading end face of the protrusion, in order to block the second discharge areas positioned back to back in the column direction from each other.

With the twelfth feature, an additional element is formed on the front substrate side and opposite a central portion in the column direction of the leading end face of the protrusion to block the second discharge areas, which are formed in a back-to-back position between the protrusion concerned and the front substrate, from each other. This construction allows the proper introduction of charged particles, produced by the addressing discharge in the second discharge area, into the first discharge area paired with the second discharge area concerned.

To attain the aforementioned object, a plasma display panel according to a thirteenth feature has, in addition to the configuration of the eleventh feature, a configuration in which a part of the column electrode facing each second discharge area is increased in width.

With the thirteenth feature, the column electrode is designed to have an increased width in the part opposite to the row electrode on both sides of the second discharge area for the creation of the addressing discharge between the column and row electrodes, to increase an electrode area for the stabilized discharge properties of the addressing discharge. Further, selectively establishing the width of the column electrode facilitates the control of the amount of charged particles to be produced by the addressing discharge.

These and other objects and advantages of the present invention will become obvious to those skilled in the art upon review of the following description, the accompanying drawings and appended claims.

DETAILED DESCRIPTION OF THE PREFERRED EMBODIMENTS

Preferred embodiments according to present invention will be described below in detail with reference to the accompanying drawings.

Figure 1:
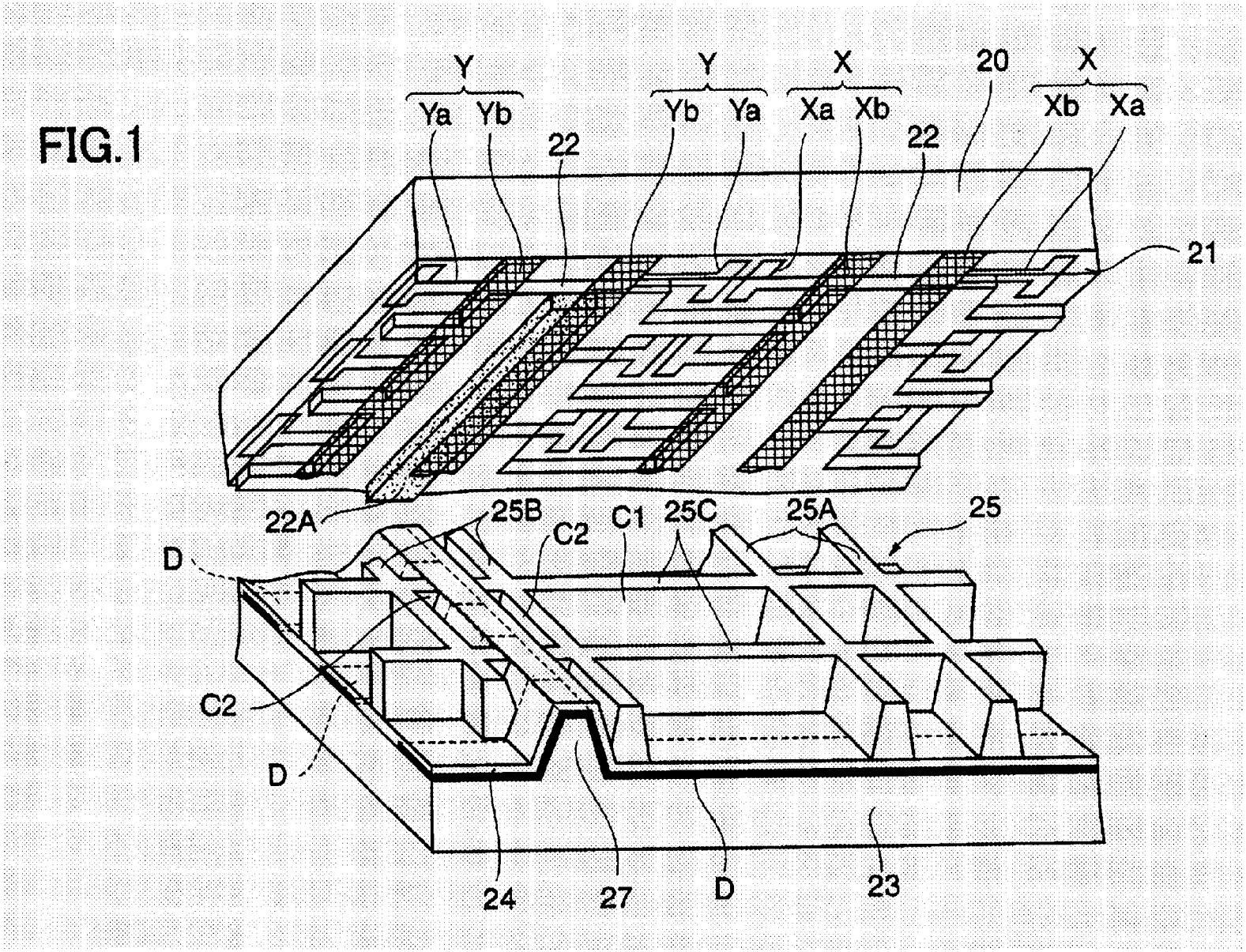
FIG. 1 is a schematic perspective view of a first embodiment according to the present invention with the separation of a front glass substrate side and a back glass substrate side.
Figure 2:
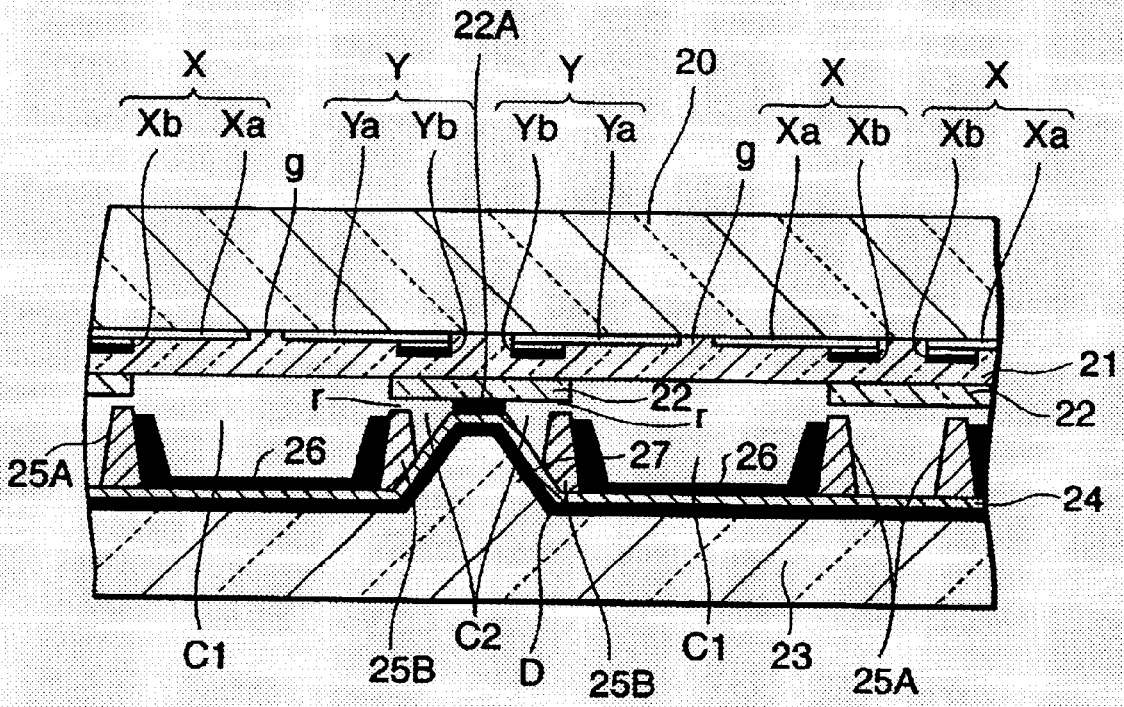
FIG. 2 is a sectional side view taken along a central position of a discharge cell in the column direction in the first embodiment.

FIG. 1 and FIG. 2 illustrate a first embodiment of a plasma display panel (hereinafter referred to as "PDP") according to the present invention. FIG. 1 is a schematic perspective view of the PDP in the first embodiment with the separation of a front glass substrate side and a back glass substrate side. FIG. 2 is a sectional view taken along a central position of the discharge cell of the PDP in a column direction.

The PDP illustrated in FIGS. 1 and 2 includes a front glass substrate 20 serving as a display surface. Row electrode pairs (X, Y) are arranged on the back surface of the front glass substrate 20 at regular intervals in the column direction (right-left direction of FIG. 2), and each extend in the row direction of the substrate 20 (in the direction at right angles to that shown in FIG. 2).

One row electrode X in each row electrode pair (X, Y) includes transparent electrodes Xa each of which is formed of a T-shaped transparent conductive film made of ITO or the like, and a black bus electrode Xb which is formed of a metal film extending in the row direction of the front glass substrate 20 and connected to a base end (the foot of the "T") of each of the transparent electrodes Xa.

Likewise, the other row electrodes Y in each row electrode pair (X, Y) includes transparent electrodes Ya each of which is formed of a T-shaped transparent conductive film made of ITO or the like, and a black bus electrode Yb which is formed of a metal film extending in the row direction of the front glass substrate 20 and connected to a base end (the foot of the "T") of each of the transparent electrodes Ya.

The transparent electrodes Xa, Ya are arranged at regular intervals along the corresponding bus electrodes Xb, Yb of the respective row electrodes X, Y. In each row electrode pair, the paired transparent electrodes Xa, Ya extend in the direction of its row electrode partner in such a way that the leading ends (the arm of the "T") of the respective transparent electrodes Xa, Ya are opposite each other with the interposition of a discharge gap g having a required width.

The row electrode pairs (X, Y) are arranged in a form in which the row electrodes X and Y are alternately transposed in adjacent row electrode pairs (X, Y) in the column direction of the front glass substrate 20, namely in the form X-Y, Y-X, X-Y, . . .

Each of the row electrode pairs (X, Y) forms a display line L extending in the row direction.

On the back surface of the front glass substrate 20, a dielectric layer 21 is formed so as to cover the row electrode pairs (X, Y). On the back surface of the dielectric layer 21, an additional dielectric layer 22 protrudes backward from a portion of the dielectric layer 21 (downward in FIG. 2) opposite to a predetermined region, as described later, including two back-to-back bus electrodes Xb (two back-to-back bus electrodes Yb) of the adjacent row electrode pairs (X, Y), and it also extends in parallel to the corresponding bus electrodes Xb (Yb).

The back surfaces of the dielectric layer 21 and additional dielectric layers 22 are covered with a protective layer made of MgO (not shown).

A black-colored additional element 22A is formed of black light absorption materials on the protective layer covering the additional dielectric layer 22 located exclusively opposite the two back-to-back bus electrodes Yb of the adjacent row electrodes Y as described above. The additional element 22A protrudes toward the rear of the PDP from the portion of the back surface of the protective layer opposite the region between the two back-to-back bus electrodes Yb of the row electrodes Y in the adjacent row electrode pairs (X, Y).

The front glass substrate 20 is situated in parallel to a back glass substrate 23 to define a discharge space between them.

The back glass substrate 23 includes a plurality of column electrodes D formed on the surface facing the display surface. The column electrodes D are arranged parallel to each other at predetermined intervals, and each extend in a direction at right angles to the bus electrodes Xb, Yb (in the column direction) in a position opposite to the paired transparent electrodes Xa and Ya in the row electrode pairs (X, Y).

On the surface of the back glass substrate 23 on the display surface side, a white-colored column-electrode protective layer (dielectric layer) 24 covers the column electrodes D, and a partition wall 25 shaped as detailed below is formed on the column-electrode protective layer 24.

The partition wall 25 includes, when viewed from the front glass substrate 20, first transverse walls 25A each of which extends in the row direction in a position overlapping the bus electrode Xb of the row electrode X in each row electrode pair (X, Y); second transverse walls 25B each of which extends in the row direction along the edge of the bus electrode Yb of each row electrode Y near the row electrode X paired therewith; and vertical walls 25C each of which extends in the column direction between the adjacent column arrays of transparent electrodes Xa and Ya which are arranged at regular intervals along the corresponding bus electrodes Xb, Yb of the row electrodes X, Y in the row direction.

In this way, the partition wall 25 has the arrangement of two first transverse walls 25A and two second transverse walls 25B, which are positioned back to back in between adjacent display lines, in alternate positions in the column direction.

The second transverse wall 25B is out of contact with the back surface of the protective layer covering the additional dielectric layer 22 so that a clearance r is formed between the front face of the wall 25B and the protective layer covering the layer 22.

The opposed first and second transverse walls 25A and 25B and the vertical walls 25C of the partition wall 25 define each of display discharge cells C1 at areas each opposite to the paired transparent electrodes Xa and Ya of the row electrode pair (X, Y) in the discharge space between the front and back glass substrates 20 and 23.

A phosphor layer 26 (not shown in FIG. 1) is provided in each display discharge cell C1 to overlay five faces facing the discharge space inside each cell C1: the face of the column-electrode dielectric layer 24 and the four side faces of the first and second transverse walls 25A and 25B and vertical walls 25C of the partition wall 25. The phosphor layers 26 in the respective display cells C1 are arranged in the order red color, green color and blue color in the row direction.

A protrusion rib 27 protrudes into a space between the two second transverse walls 25B positioned back to back in between adjacent display lines, from a portion of the back glass substrate 23 facing the space.

The protrusion rib 27 is trapezoidal in cross section and has a band-like shape extending in the row direction. The protruding rib 27 raises a portion of the column electrode D located between the two back-to-back second transverse walls 25B and the column-electrode protective layer 24 covering the column electrode D, in the direction of the front glass substrate 20 until the portion of the layer 24 raised by the rib 27 comes in contact with the black additional element 22A formed on the back surface of the additional dielectric layer 22.

Thus, the protrusion rib 27 and the black additional element 22A divide the space, surrounded by the two back-to-back second transverse walls 25B and vertical walls 25C between the front and back glass substrates 20 and 23, at the central position in the column direction in order to form two addressing discharge cells C2 on both sides of the rib 27 and the element 22A concerned.

Each of the resulting addressing discharge cells C2 is communicated to the display discharge cell C1, adjoining thereto with the second transverse wall 25B in between in the column direction, by means of the clearance r which is formed between the front face of the interposed second wall 25B and the protective layer covering the additional dielectric layer 22.

The bus electrode Yb of the row electrode Y is opposite to the part of the column electrode D which is inclined along the side face of the protrusion rib 27, with each addressing discharge cell C2 in between.

The addressing discharge cell C2 does not incorporate the phosphor layer as provided in the display discharge cell C1.

Each display discharge cell C1 and each addressing discharge cell C2 are filled with a discharge gas.

The PDP as described above generates images through the following procedure.

First, in each of the display discharge cells C1, a reset discharge in a reset period is caused to form wall charges on the dielectric layer 21.

In an addressing period following the reset period, a scan pulse is applied to the row electrode Y and a data pulse is applied to the column electrode D.

At this point, the addressing discharge occurs between the inclined part of the column electrode D and the bus electrode Yb of the row electrode Y within the addressing discharge cell C2, because the space-distance between the bus electrode Yb of the row electrode Y and the inclined part of the column electrode D following the inclined side face of the protrusion rib 27 which are opposite to each other with the addressing discharge cell C2 intervening, is smaller than the space-distance between the transparent electrode Ya of the row electrode Y and the column electrode D which are opposite to each other with the display discharge cell C1 intervening.

Charged particles generated by the addressing discharge in the addressing discharge cell C2 pass through the clearance r formed between the second transverse wall 25B and the additional dielectric layer 22, and flow into the display discharge cell C1 adjoining to the cell C2 with the second transverse wall 25B in between. Thereupon, the wall charges existing on the portion of the dielectric layer 21 facing the display discharge cell C1 are erased. Thus, lighted cells (the display discharge cell C1 having wall charges formed on the dielectric layer 21) and non-lighted cells (the display discharge cell C1 having no wall charges on the dielectric layer 21) are distributed in all display lines over the panel surface in accordance with the image to be displayed.

In a sustaining emission period after completion of the addressing period, a discharge sustaining pulse is applied alternately to the row electrodes X and Y of each row electrode pairs (X, Y) in all of the display lines L at one operation. Every time the discharge sustaining pulse is applied, a sustaining discharge occurs between the opposite transparent electrodes Xa and Ya in each lighted cell, whereupon ultraviolet light is generated. The generated ultraviolet light excites each of the red, green and blue phosphor layers 26 facing the display discharge cells C1 to allow them to emit light, thereby forming a display image.

With the above PDP, the addressing discharge for distributing the lighted cells and the non-light cells over the panel surface in accordance with the image to be displayed is created within the addressing discharge cell C2 which does not have the phosphor layer formed therein because the cell C2 is formed separately from the display discharge cell C1 experiencing the sustaining discharge for allowing the phosphor layers 26 to emit color light for the generation of an image. Accordingly, the addressing discharge is never subjected to the influences ascribable to the phosphor layer, e.g., discharge properties varying among the phosphor materials for the colors forming the phosphor layers, variations in the thickness of the phosphor layer produced in the manufacturing process for the PDP.

In the PDP, the bus electrode Yb of the row electrode Y is opposite to the inclined part of the column electrode D following the side face of the protrusion rib 27 with the addressing discharge cell C2 intervening, so that the addressing discharge occurs between the inclined part of the column electrode D and the bus electrode Yb of the row electrode Y. Accordingly, even if there are variations in the distances between the front and back glass substrates 20 and 23, in the heights of the protrusion ribs 27, and the like, a discharge starting voltage for the addressing discharge is prevented from being affected by the above variations in the distances between the front and back glass substrates 20 and 23, in the heights of the protrusion ribs 27 and the like because an adequate discharge distance for creating the addressing discharge at an established discharge starting voltage is ensured between the bus electrode Yb and any point of the inclined part of the column electrode D.

The PDP includes the protrusion rib 27 to make the addressing discharge distance between the bus electrode Yb and the column electrode D in the addressing discharge cell C2 smaller than the sustaining discharge distance between the transparent electrode Ya and the column electrode D in the display discharge cell C1. Hence, the PDP achieves a reduction in discharge starting voltage for the addressing discharge. In addition, it is possible to increase the volumetric capacity of the display discharge cell C1 by means of an increase in the height of the partition wall 25 without changing the addressing discharge distance. This adaptable design permits the setting for improving the luminous efficiency in the display discharge cell C1 while leaving a low discharge starting voltage for the addressing discharge.

Further the PDP has a construction in which the two addressing discharge cells C2 are formed between the opposite second transverse walls 25B in between adjacent display lines, and blocked from each other in a back-to-back position in the column direction by the protrusion rib 27 and the black additional element 22A. This construction makes it possible to arrange the bus electrodes Yb of the row electrodes Y, each opposite to the inclined part of the column electrode D on both sides of the addressing discharge cell C2, in a back-to-back position in between adjacent row electrode pairs (X, Y). As a natural result, the row electrodes X and Y of the row electrode pairs (X, Y) are transposed in each row electrode pair (X, Y) in the column direction, that is to say the pairs (X, Y) are arranged in the form X-Y, Y-X, X-Y, . . .

Accordingly, when a sustaining pulse is alternately applied to the row electrodes X and Y of each row electrode pair (X, Y) for the creation of the sustaining discharge, due to the fact that the back-to-back row electrodes in the column direction are the same type electrode, discharge capacity is not produced in the non-display area located between the adjacent row electrodes (X, Y), leading to the prevention of occurrence extra reactive power resulting from the sustaining discharge.

Still further, the PDP includes, when viewed from the front glass substrate 20, a non-display area between the second transverse walls 25B is covered with the black conductive layer forming the bus electrode Yb and the black additional element 22A, in order to prevent the reflection of ambient light incident from the front glass substrate 20 for an improvement in contrast in the display image and also to prevent the light emission caused by the addressing discharge in the addressing discharge cell C2 from leaking toward the display surface of the front glass substrate 20.

The PDP includes the protrusion rib 27 formed combinedly with the back glass substrate 23. However, the protrusion rib 27 may be formed by the steps of coating the back glass substrate 23 with a glass paste and then cutting away the glass paste layer as in the case of forming the partition wall 25.

Regarding the construction for establishing a communication between the display discharge cell C1 and the addressing discharge cell C2 which are paired with each other, in addition to the method described in the first embodiment, some other menthods can be employed, for example, a groove connecting the display discharge cell C1 and the addressing discharge cell C2 can be formed in the top portion of a second transverse wall or in an additional dielectric layer in contact with the second transverse wall, or alternatively the second transverse wall and the additional dielectric layer can be offset in position from each other to form a clearance connecting the display discharge cell C1 and the addressing discharge cell C2.

Figure 3:
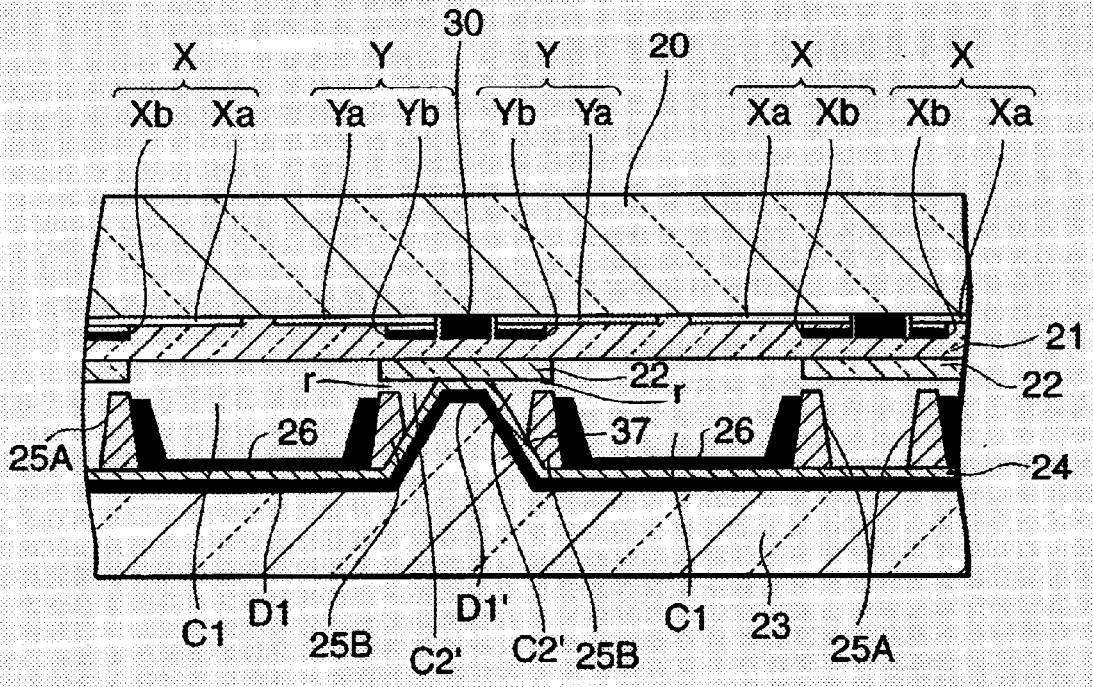
FIG. 3 is a sectional side view of a discharge cell in a second embodiment which is taken along the same position as that in FIG. 2.
Figure 4:
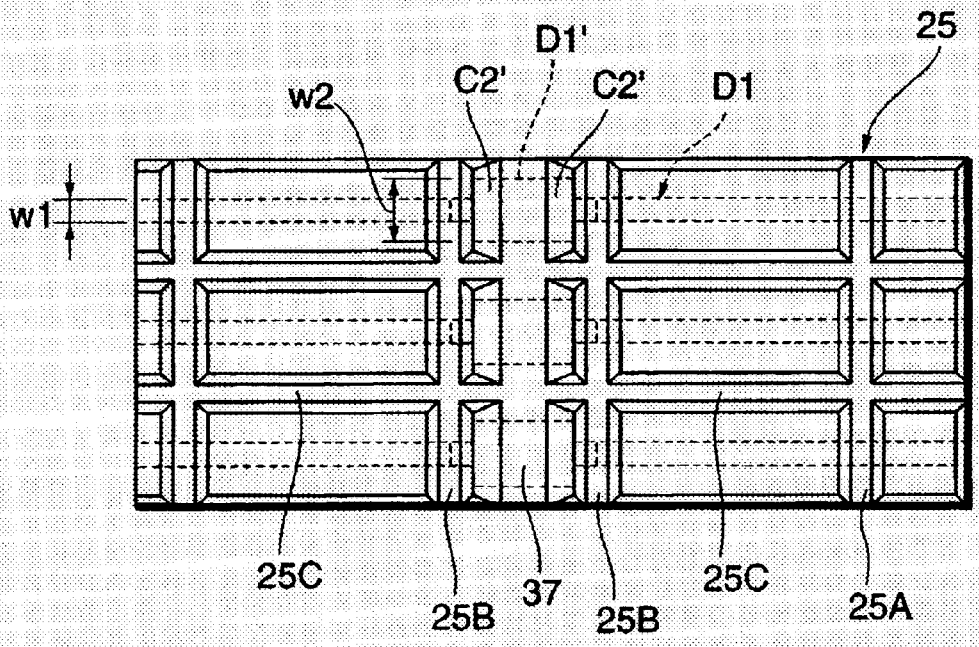
FIG. 4 is a front view illustrating a back glass substrate in the second embodiment.

FIG. 3 and FIG. 4 are views illustrating a second embodiment of the PDP according to the present invention. FIG. 3 is a sectional view taken along the same position as that in FIG. 2 of the first embodiment. FIG. 4 is a front view illustrating the back glass substrate on the display side.

As illustrated in FIG. 3, the PDP of the second embodiment does not include an additional element, resembling the black-colored additional element 22A provided in the PDP of the first embodiment, on the additional dielectric layer 22 opposite the back-to-back bus electrodes Yb of the respective row electrodes Y and the region between the bus electrodes Yb concerned. However, the second embodiment provides a protrusion rib 37 raising a column electrode D1 between the back-to-back second transverse walls 25B from the back glass substrate 23 in the direction of the front glass substrate 20 until the leading end face of the rib 37 covered with the column-electrode protective layer 24 is in contact with the back surface of the additional dielectric layer 22.

As illustrated in FIG. 4, the PDP includes a widened portion D1' in a part of the column electrode D1 raised from the back glass substrate 23 by the protrusion rib 37. The widened portion D1' has a width w2 larger than a width w1 of other parts (extending in parallel to the back glass substrate 23) of the column electrode D1 in the row direction (the vertical direction of FIG. 4).

The configuration of other components in the second embodiment is approximately the same as that of the PDP in the first embodiment, and such components are designated by the same or similar reference numerals.

Although the PDP of the second embodiment generates the addressing discharge in an addressing discharge cell C2' as in the case of the first embodiment, the column electrode D1 has the widened portion D1' formed in the part raised from the back glass substrate 23 by the protrusion rib 37 so that the addressing discharge occurs between the widened portion D1' of the column electrode D1 and the bus electrode Yb of the row electrode Y.

In this way, due to having a large electrode area established on the column electrode D1 giving rise to the addressing discharge, the PDP can provide the stabilized discharge properties of the addressing discharge and also a simplified control of the amount of wall charges formed on the dielectric layer 21.

The PDP further has light absorption layers 30 provided between the back-to-back bus electrodes Xb of the respective row electrodes X and between the back-to-back bus electrodes Yb of the respective row electrodes Y on the back surface of the front glass substrate 20. When viewed from the front glass substrate 20, each of the non-display areas located between the first transverse walls 25A and between the second transverse walls 25B is covered with the black conductive layer forming each of the bus electrodes Xb, Yb and the light absorption layer 30. Hence, the reflection of ambient light incident from the front glass substrate 20 is prevented for an improvement in contrast in the displayed image. Moreover, in the portion of the non-display area opposite the addressing discharge cell C2', the tight emission generated by the addressing discharge within the cell C2' is prevented from leaking toward the display surface of the front glass substrate 20.

Figure 5:
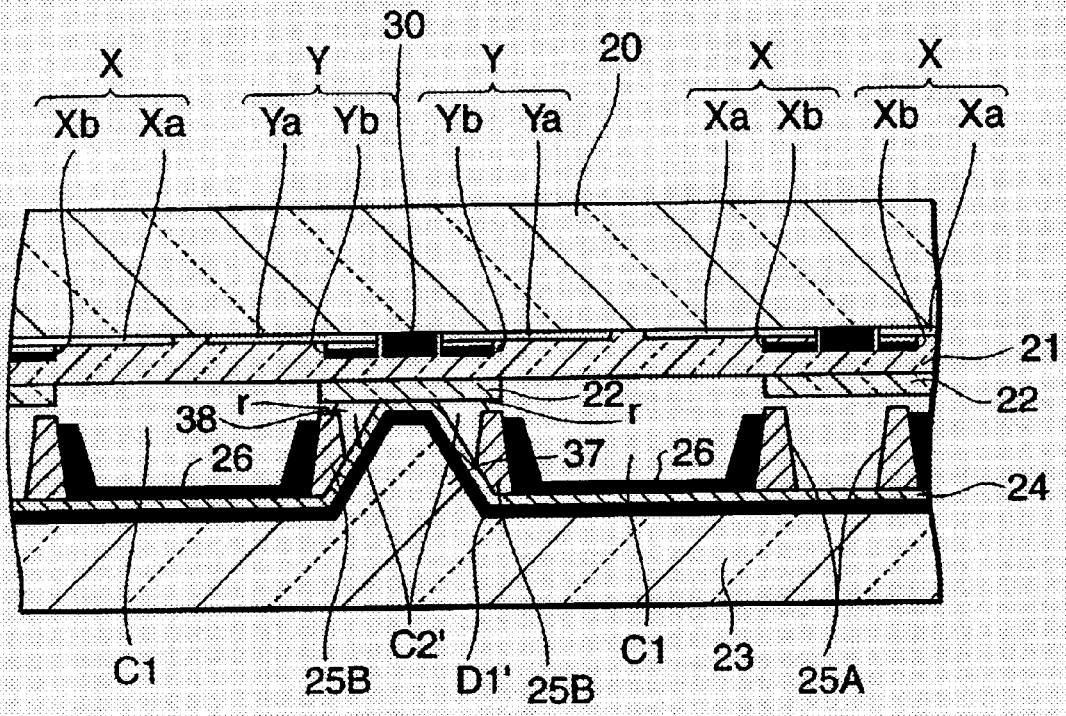
FIG. 5 is a sectional side view of a discharge cell in a third embodiment which is taken along the same position of as that in FIG. 2.
Figure 6:
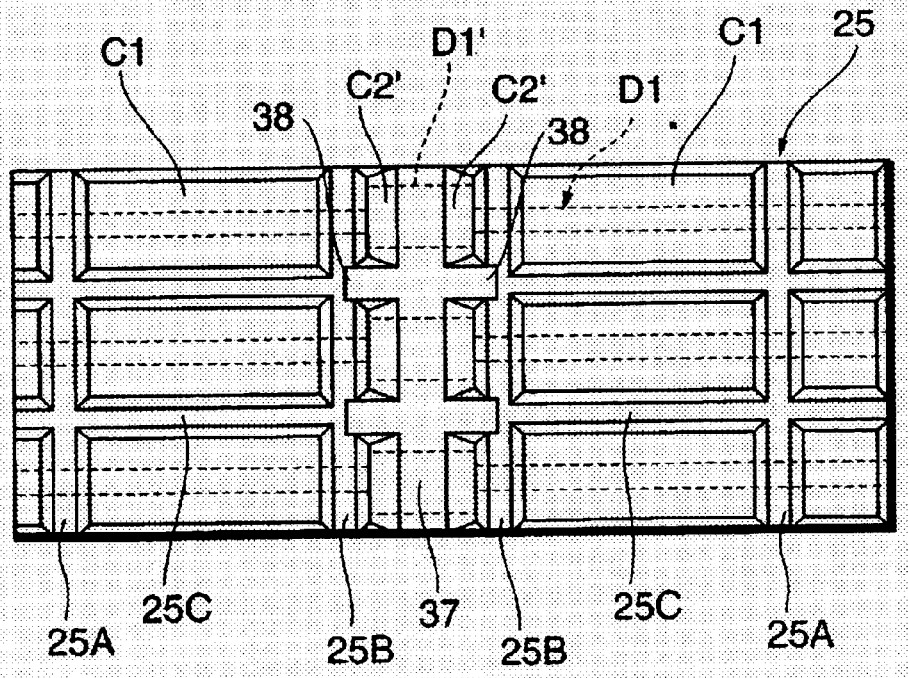
FIG. 6 is a front view illustrating a back glass substrate in the third embodiment.

FIG. 5 and FIG. 6 are views illustrating a third embodiment of the PDP according to the present invention, FIG. 5 being a sectional view taken along the same position as in that in FIG. 2 of the first embodiment, and FIG. 6 being a front view of the back glass substrate on the display side.

The PDP of the third embodiment includes a shielding wall 38 formed combinedly with the protrusion rib 37 which raises the column electrode D1 between the back-to-back second transverse walls 25B from the back glass substrate 23 so as to make it protrude toward the front glass substrate 20. The shielding wall 38 protrudes in the column direction from both of the inclined side faces of the protrusion rib 37 in a central position between the adjacent column electrodes D1, namely, in a position aligned parallel to the vertical wall 25C in the column direction.

The shielding wall 38 has a leading end face (an upper face in FIG. 5) facing toward the front glass substrate 20 and positioned flush with the leading end face of the protrusion rib 37 so that the leading end faces of the wall 38 and the rib 37 are in contact with the back surface of the additional dielectric layer 22. Additionally, each of the ends of the shielding wall 38 in the column direction is joined to the second transverse wall 25B adjacent to the protrusion rib 37.

Thus, the shield wall 38 acts, in the row direction, as a shield between adjacent two column arrays of the two addressing discharge cells C2' which are formed on both sides of each protrusion rib 37 in the column direction.

The configuration of other components in the third embodiment is approximately the same as that of the PDP in the second embodiment, and such components are designated by the same or similar reference numerals.

The PDP of the third embodiment includes the shielding wall 38 provided for a shield between the adjacent addressing discharge cells C2' in the row direction. Hence, when the addressing discharge is created in the addressing discharge cells C2', the addressing discharge occurring one cell C2' is prevented from spreading out into another cell C2' adjacent to the one cell C2' in the row direction and charged particles produced by the addressing discharge are prevented from flowing into another cell C2' adjacent to the one cell C2' in the row direction. As a result, the PDP ensures the introduction of the charged particles produced by the addressing discharge into the display discharge cell C1 paired with the one cell C2'.

Figure 7:
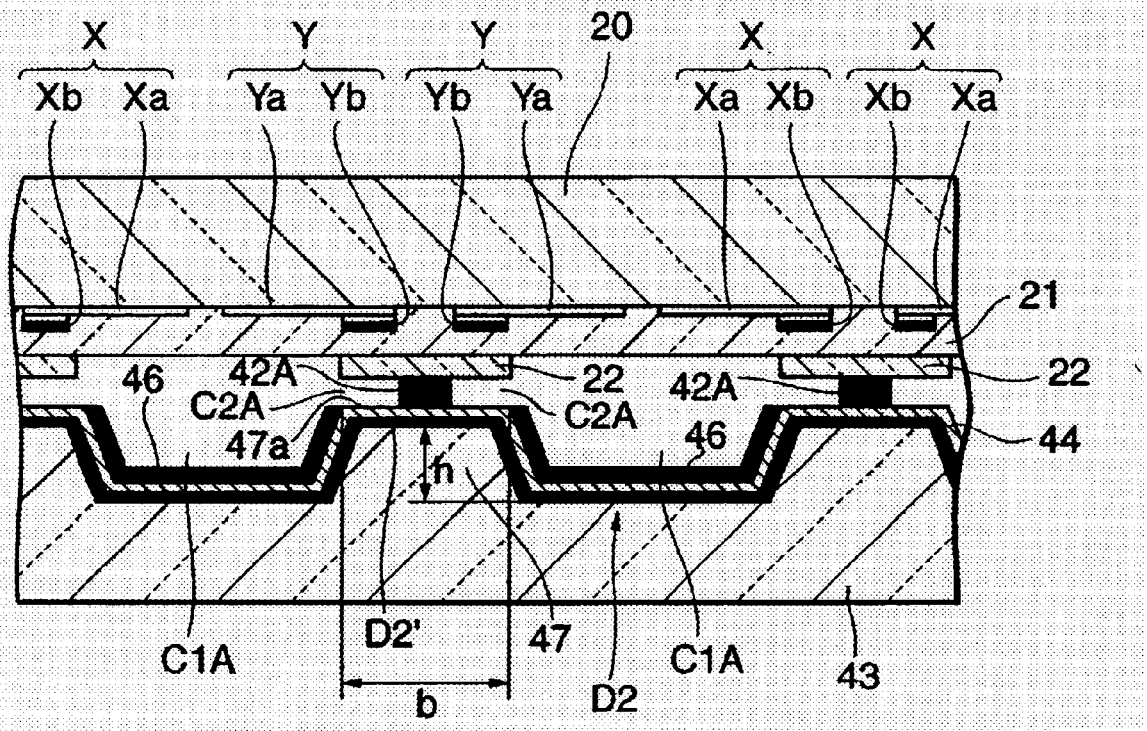
FIG. 7 is a sectional side view of a discharge cell in a fourth embodiment which is taken along the same position as that in FIG. 2.
Figure 8:
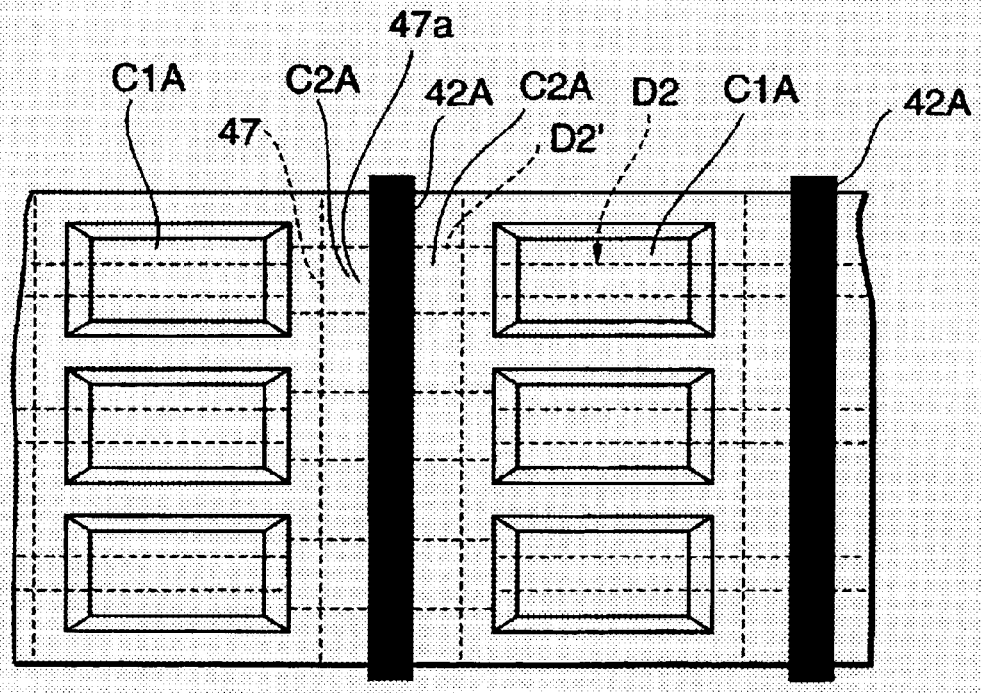
FIG. 8 is a front view illustrating a back glass substrate in the fourth embodiment.
Figure 9:
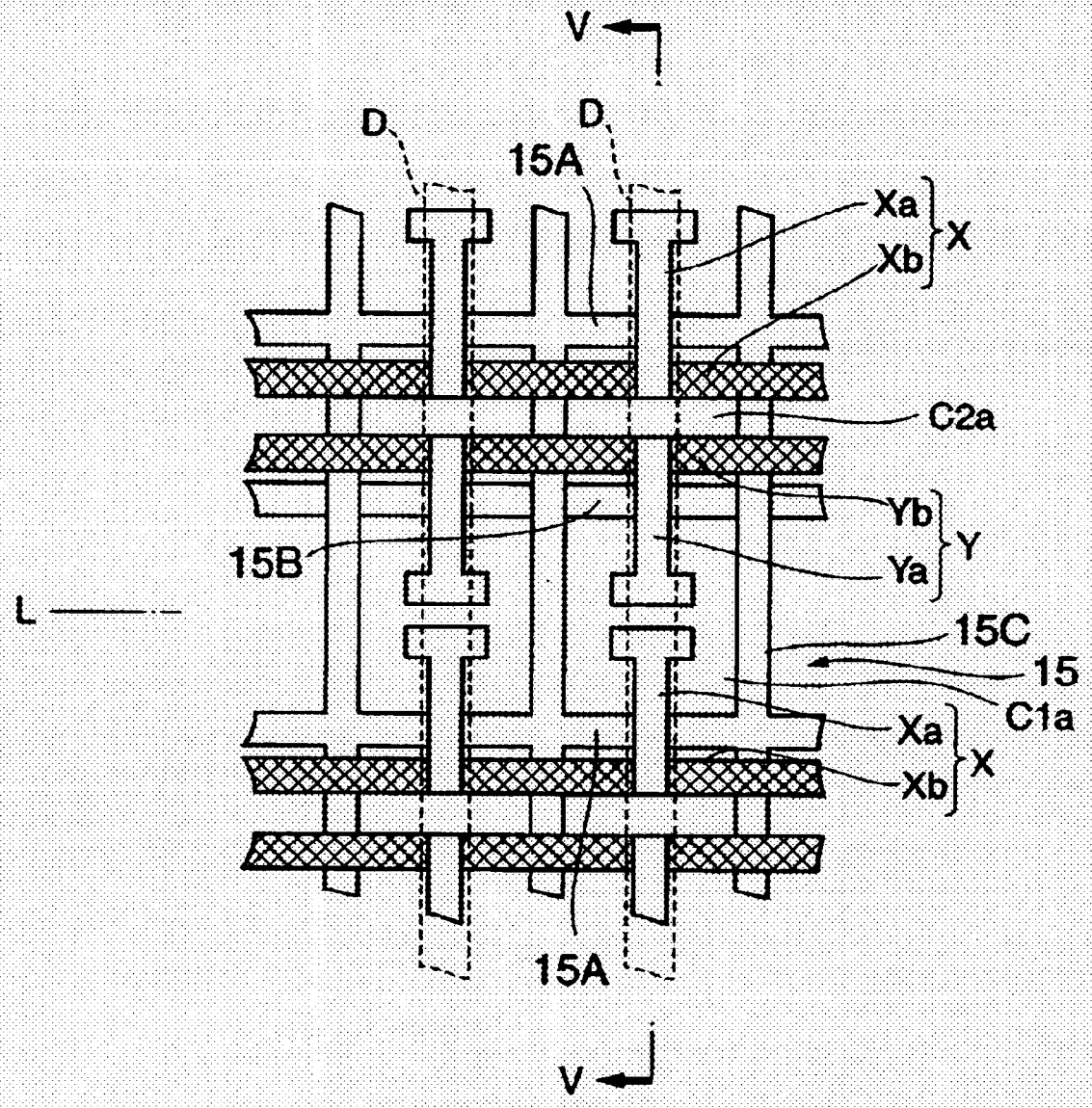
FIG.9 PRIOR ART
FIG. 9 is a schematic front view illustrating a plasma display panel suggested prior to the present application.
Figure 10:
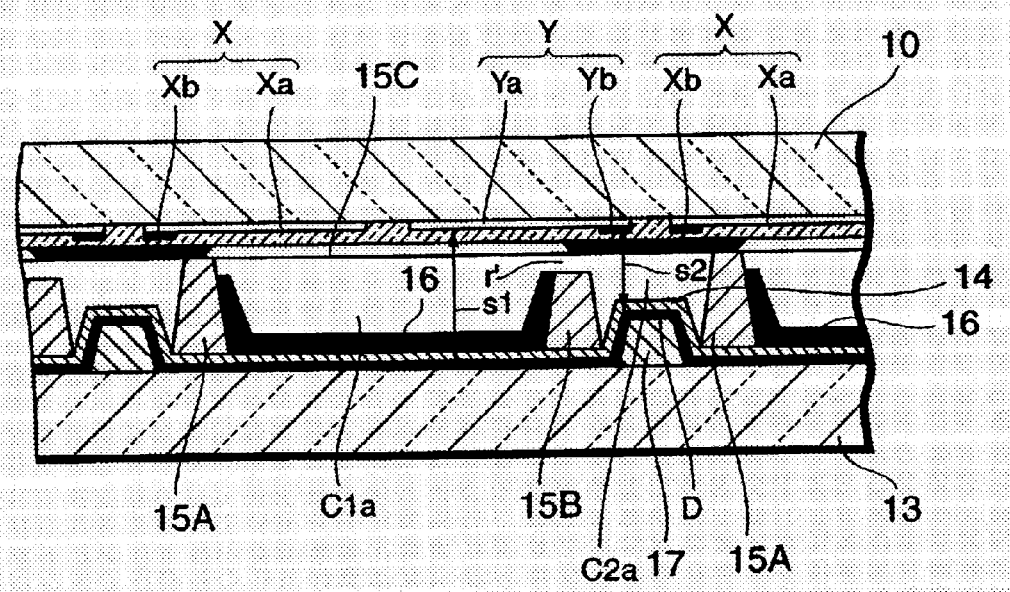
FIG.10 PRIOR ART
FIG. 10 is a sectional view taken along the V—V line in FIG. 9.
Figure 11:
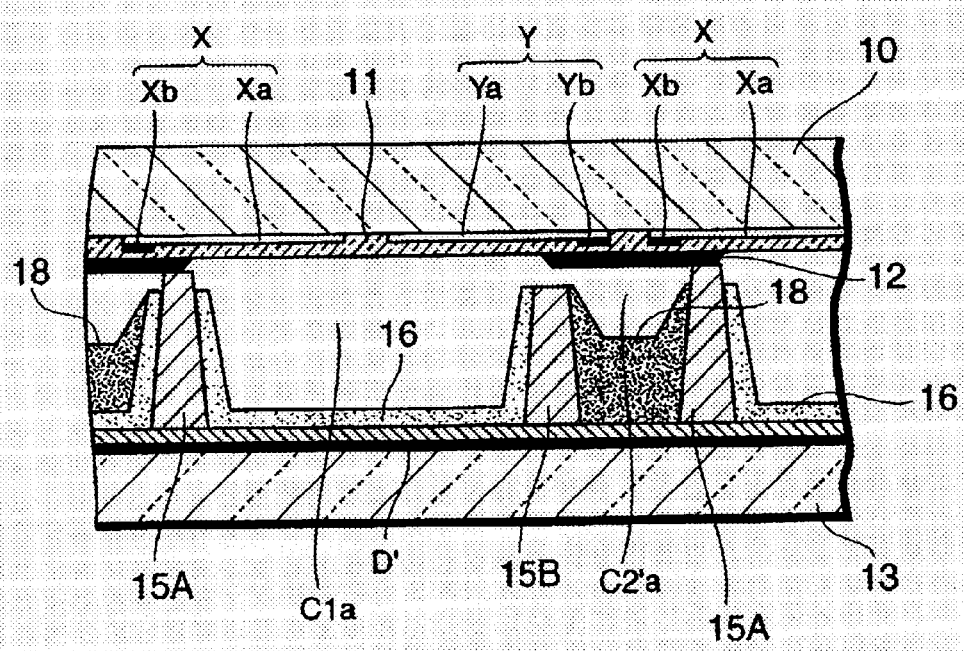
FIG.11 PRIOR ART
FIG. 11 is a sectional view illustrating another example of the plasma display panel suggested prior to the present application.

FIG. 7 and FIG. 8 are views illustrating a fourth embodiment of the PDP according to the present invention, FIG. 7 being a sectional view taken along the same position as that in FIG. 2 of the first embodiment, and FIG. 8 a front view illustrating the back glass substrate on the display side.

The PDP of the fourth embodiment includes a protrusion rib 47 formed combinedly on the surface of a back glass substrate 43 facing toward the front glass substrate 20 by applying sandblast treatment to a glass substrate.

The protrusion rib 47 is trapezoidal in cross section and has a height h smaller than the distance between the surface of the back glass substrate 43 on the display side and the back face of the additional dielectric layer 22 to be spaced from the layer 22 at a predetermined interval.

Further, the protrusion rib 47 has a top face 47 opposite the additional dielectric layer 22. The top face 47*a* has a width b, in the column direction, approximately equal to the width, in the column direction, of each of (a) the section including two bus electrodes Xb positioned back to back in between the adjacent row electrode pairs (X, Y) and the region between the two bus electrodes Xb, and (b) the section including two back-to-back bus electrodes Yb and the region between the two bus electrodes Yb.

The protrusion rib 47 raises the column electrode D2 along the outside face of the rib 47 to make it protrude toward the front glass substrate 20 and its surface is covered with the column-electrode protective layer 44.

The protrusion rib 47 also serves as a transverse wall for partitioning off a display discharge cell C1A from an adjacent display discharge cell C1A in the column direction. Therefore, the PDP of the fourth embodiment is not provided with the first transverse wall and the second transverse wall as described in the first, second and third embodiments.

The column electrode D2 has a widened portion D2' formed in the part raised by the protrusion rib 47.

On the additional dielectric layer 22, a band-shaped black-colored additional element 42A formed of black light absorption materials protrudes toward the back glass substrate 43 and extends in the row direction on a portion of the protective layer, covering the back surface of the additional dielectric layer 22, opposite each region between the two bus electrodes Xb positioned back to back in between the adjacent row electrode pairs (X, Y) and similarly between the two back-to-back bus electrodes Yb.

The black additional element 42A is joined to the column-electrode protective layer 44, covering the protrusion rib 47 and the column electrode D2, on the top face 47*a* of the protrusion rib 47, so that the space between the protrusion rib 47 and the additional dielectric layer 22 is divided in the column direction to form two addressing discharge cells C2A between the additional dielectric layer 22 and the top face 47*a* of the rib 47 opposite to the bus electrodes Yb.

A phosphor layer 46 is formed in the display discharge cell C1A formed between the protrusion ribs 47.

The configuration of other components on the front glass substrate 20 side in the fourth embodiment is approximately the same as that of the PDP in the first embodiment, and such components are designated by the same or similar reference numerals.

The PDP of the fourth embodiment is designed such that the addressing discharge for distribution of the lighted cells and the non-lighted cells over the panel surface in accordance with the image to be displayed is created within the addressing discharge cell C2A which is separately from the display discharge cell C1A, experiencing the sustaining discharge for allowing the phosphor layer 46 to emit light for the generation of an image, so that the phosphor layer is not formed in the cell C2A. For this reason, the addressing discharge is never subjected to influences ascribable to the phosphor layer, such as discharge properties varying among the phosphor materials of the three colors forming the phosphor layers, variations in the thickness of the phosphor layers produced in the manufacturing process, and the like.

Further, the PDP includes the protrusion rib 47 to make the addressing discharge distance between the bus electrode Yb and the column electrode D2 in the addressing discharge cell C2A smaller than the sustaining discharge distance between the transparent electrode Ya and the column electrode D2 in the display discharge cell C1A. Hence, the PDP achieves a reduction in discharge starting voltage for the addressing discharge. In addition, it is possible to increase the volumetric capacity of the display discharge cell C1A without changing the addressing discharge distance. This adaptable design permits the setting for improving the luminous efficiency in the display discharge cell C1A while leaving a low discharge starting voltage for the addressing discharge.

Still further the PDP includes the black additional element 42A dividing the space between the protrusion rib 47 and the additional dielectric layer 22 to form the two addressing discharge cells C2A in a back-to-back position in the column direction. This construction allows the bus electrodes Yb of the row electrodes Y, which are opposite to the widened portion D2' of the column electrode D2 protruded by the protrusion rib 47 with the addressing discharge cells C2A intervening, to be arranged in a back-to-back position in adjacent row electrode pairs (X, Y). As a natural result, the row electrodes X and Y of the row electrode pairs (X, Y) are transposed in each row electrode pair (X, Y) in the column direction, that is to say the pairs (X, Y) are arranged in the form X-Y, Y-X, X-Y, . . .

Accordingly, when a sustaining pulse is alternately applied to the row electrodes X and Y of each row electrode pair (X, Y) for the creation of the sustaining discharge, due to the fact that the back-to-back row electrodes in the column direction are the same type electrode, discharge capacity is not produced in the non-display area located between the adjacent row electrodes (X, Y). This prevents the occurrence of extra reactive power resulting from the sustaining discharge.

Still further, in the PDP, when viewed from the front glass substrate 20, the non-display area including two back-to-back bus electrodes Xb (two back-to-back bus electrodes Yb) and the region between the bus electrodes Xb (Yb) is covered with the black conductive layer forming the bus electrode Xb (Yb) and the black additional element 42A. Thus, the PDP achieves the prevention of the reflection of ambient light incident from the front glass substrate 20 for an improvement in contrast in the display image and also the prevention of a leak of light emission, caused by the addressing discharge in the addressing discharge cell C2A, toward the display surface of the front glass substrate 20.

The PDP is constructed such that the protrusion rib 47 serves as a transverse wall of the partition wall for partitioning off a display discharge cell C1A from another display discharge cell C1A adjacent thereto in the column direction. Hence, the fourth embodiment does not require to provide additionally a transverse wall as described in the first, second and third embodiments.

The terms and description used herein are set forth by way of illustration only and are not meant as limitations. Those skilled in the art will recognize that numerous variations are possible within the spirit and scope of the invention as defined in the following claims.

What is claimed is:

1. A plasma display panel including, a front substrate, a plurality of row electrode pairs regularly arranged in a column direction on a back surface of the front substrate, and each extending in a row direction to form a display line and constituted by first and second row electrodes, a back substrate placed opposite the front substrate with a discharge space intervening between; and a plurality of column electrodes regularly arranged in the row direction on a surface of the back substrate facing toward the front substrate, and each extending in the column direction to intersect the row electrode pairs and form unit light-emitting areas in the discharge space at the respective intersections, said plasma display panel comprising:

a first discharge area provided in each of the unit light-emitting area and facing opposed parts of the first and second row electrodes to provide for a discharge between the first and second row electrodes; and a second discharge area provided in each of the unit light-emitting area and facing a part of the first row electrode, positioned opposite to a part thereof opposing the second row electrode and creating a discharge in association with the column electrode, to provide for a discharge between the part of the first row electrode and the column electrode, said first discharge areas and said second discharge areas in the individual unit light-emitting areas being arranged in alternate positions in the column direction so that the second discharge areas of the respective unit light-emitting areas adjacent to each other are arranged in a back-to-back position in the column direction.

2. A plasma display panel according to claim 1 further comprising a protrusion protruding from the back substrate in the direction of the front substrate and extending in the row direction, to establish a partition between said second discharge areas positioned back to back with each other in the column direction.

3. A plasma display panel according to claim 2, wherein both side faces of said protrusion respectively facing said second discharge areas are inclined toward each other so as to narrow toward an leading end of the protrusion, and parts of the column electrode facing the second discharge areas follow the inclined side faces of the protrusion to protrude toward the front substrate, and the part of the column electrode inclined along each of the inclined side faces of the protrusion is opposite to the part of the first row electrode, positioned opposite to the part thereof opposing the second row electrode, to cause the discharge between the part of the column electrode and the corresponding part of the first row electrode.

4. A plasma display panel according to claim 2, wherein a leading end of said protrusion is in contact with part of the front substrate to block said second discharge areas positioned back to back in the column direction from each other, further comprising:

a dividing wall extending in the row direction and providing a division between said paired first and second discharge areas forming the unit light-emitting area; and a communication element provided between said dividing wall and the front substrate for communication between said paired first and second discharge areas.

5. A plasma display panel according to claim 2, further comprising a shielding wall provided on a portion of said protrusion between said second discharge areas adjacent to each other in the row direction and projecting from both side faces of the protrusion to shield the adjacent second discharge areas in the row direction from each other.

6. A plasma display panel according to claim 1, wherein a part of said column electrode facing each of said second discharge area is increased in width.

7. A plasma display panel according to claim 1, wherein said first row electrode and said second row electrode which constitute each row electrode pair are alternately transposed in the column direction so that the first row electrodes of the adjacent row electrode pairs are arranged back to back and the second row electrodes are similarly arranged back to back.

8. A plasma display panel according to claim 1, further comprising a black- or dark-colored light absorption layer provided on a portion of the front substrate opposite each of said second discharge areas.

9. A plasma display panel according to claim 8, wherein said light absorption layer is formed on the part of the first electrode opposite the column electrode with said second discharge area intervening between.

10. A plasma display panel according to claim 1, further comprising a phosphor layer provided only in said first discharge area for generating a visible light by means of a discharge.

11. A plasma display panel according to claim 1, further comprising, a protrusion projecting from the back substrate toward the front substrate and extending in the row direction between said first discharge areas arranged in the column direction for creating a partition between the first discharge areas arranged in the column direction, wherein said second discharge area is formed between a leading end face of said protrusion and the back surface of the front substrate, and said column electrode is projected toward the front substrate by the protrusion to allow a part of the column electrode projected toward the front substrate to be opposite to the part of the first row electrode, positioned opposite to the part thereof opposing the second row electrode, with the second discharge area intervening between.

12. A plasma display panel according to claim 11, further comprising an additional element protruding from the front substrate backward to come in contact with a central position in the column direction of the leading end face of said protrusion, in order to block said second discharge areas positioned back to back in the column direction from each other.

13. A plasma display panel according to claim 11, wherein a part of said column electrode facing each of said second discharge areas is increased in width.

* * * * *